US010154719B2

(12) United States Patent
Kang

(10) Patent No.: US 10,154,719 B2
(45) Date of Patent: Dec. 18, 2018

(54) DEVICE FOR PREVENTING EVAPORATION OF COSMETIC CONTENTS IN COSMETIC REFILL CASE

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 166 days.

(21) Appl. No.: 14/912,881

(22) PCT Filed: Aug. 19, 2014

(86) PCT No.: PCT/KR2014/007668
§ 371 (c)(1),
(2) Date: Feb. 18, 2016

(87) PCT Pub. No.: WO2015/026128
PCT Pub. Date: Feb. 26, 2015

(65) Prior Publication Data

US 2016/0198833 A1 Jul. 14, 2016

(30) Foreign Application Priority Data

Aug. 19, 2013 (KR) ..... 20-2013-0006921 U

(51) Int. Cl.
*A45D 40/00* (2006.01)
*A45D 40/22* (2006.01)
(Continued)

(52) U.S. Cl.
CPC ..... *A45D 40/222* (2013.01); *A45D 33/006* (2013.01); *A45D 40/22* (2013.01);
(Continued)

(58) Field of Classification Search
CPC .... A45D 40/22; A45D 40/222; A45D 33/006; A45D 33/003; A45D 2034/005;
(Continued)

(56) References Cited

U.S. PATENT DOCUMENTS 4,314,651 A * 2/1982 Gaiser ..... B65D 43/162 220/210
4,369,799 A 1/1983 Napoleon
(Continued)

FOREIGN PATENT DOCUMENTS

KR 20-2000-0019770 U 11/2000
KR 10-1112477 B1 2/2012
KR 10-1271359 B1 6/2013

*Primary Examiner* — Rachel R Steitz
(74) *Attorney, Agent, or Firm* — Heedong Chae; Lucem, PC

(57) ABSTRACT

The present invention relates to a device for preventing the evaporation of cosmetic contents in a cosmetic refill case including a support case (22) having, in the center thereof, a refill case accommodation space (22*c*) for accommodating a cosmetic refill case (10); and a coupler (24) integrated with the upper end of the support case (22) by a hinge (26), wherein the support case (22) has, in the center thereof, the refill case accommodation space (22*c*) for accommodating the cosmetic refill case (10) by a support case bottom (22*a*) and a support case side (22*b*), and furthermore, the coupler (24) forms an inverted upside-down "L" shape by allowing a coupler side (24*a*) and a coupler top (24*b*) to be formed at a right angle.

13 Claims, 8 Drawing Sheets

(51) Int. Cl.
*A45D 33/00* (2006.01)
*A45D 34/00* (2006.01)

(52) U.S. Cl.
CPC .. *A45D 2034/005* (2013.01); *A45D 2040/223* (2013.01); *A45D 2200/051* (2013.01)

(58) Field of Classification Search
CPC ..... A45D 2040/223; A45D 2200/051; B65D 43/02; B65D 45/00; B65D 45/16; B65D 45/18; B65D 45/20; B65D 45/22; B65D 21/0233; B65D 21/0201
See application file for complete search history.

(56) References Cited

U.S. PATENT DOCUMENTS 6,848,576 B1 * 2/2005 Jaron ..... B65D 11/02 206/391
8,544,648 B2 * 10/2013 Cleveland ..... B65D 21/0223 206/503
2006/0278651 A1 * 12/2006 Appelbaum ..... B65D 45/20 220/784
2007/0029226 A1 * 2/2007 Yuhara ..... A45D 33/006 206/581
2016/0015149 A1 * 1/2016 Kim ..... A45D 34/00 222/383.1

* cited by examiner

Prior Art

Prior Art

Prior Art

DEVICE FOR PREVENTING EVAPORATION OF COSMETIC CONTENTS IN COSMETIC REFILL CASE

TECHNICAL FIELD

The present invention relates to a device for preventing evaporation of cosmetic contents in a cosmetic refill case and, more particularly, to a device for preventing evaporation of cosmetic contents in a cosmetic refill case, which is used to cover the cosmetic refill case, such that cosmetics, such as compact, foundation or cosmetic cream, containing a large quantity of evaporation ingredients such as water or alcohol, are prevented from being evaporated or volatilised, wherein the cosmetic refill case used after being stored for several months is required to prevent cosmetic contents from being evaporated.

BACKGROUND ART

In general, a cosmetic refill case is used by replacing a spent cosmetic refill case as a new cosmetic refill case after the cosmetic contents of an original product are used up. Until the original product is used up, the cosmetic refill case containing cosmetic contents is required to be kept during several months to several years. If the sealing ability of the cosmetic refill case is worse, the cosmetic contents kept in the cosmetic refill case are dried so that the performance of the original cosmetic contents may be deteriorated.

Since cosmetics contain a large quantity of water or volatile ingredients, if a cosmetic container is not perfectly air-tightened, the water and volatile ingredients are evaporated and volatilized, so that the quantity of cosmetics is reduced. In addition, when the water and volatile ingredients are evaporated and volatilised, the mixing ratio between cosmetic ingredients is varied so that the performance of the cosmetics is deteriorated.

In addition, when the water and volatile ingredients of cosmetics are evaporated and volatilized, since the cosmetics are dried so that the original function of cosmetics is lost, it is very important to keep the cosmetics to maintain the original ingredients of the cosmetics.

To solve the above-described problems, a cosmetic refill case according to the related art employs a sealing cap for maintaining air-tightness in order to prevent water and volatile ingredients from, being evaporated and volatilised. In general, a cosmetic refill case according to the related art employs an elastic packing for maintaining air tightness in order to secure the air tightness.

Thus, according to the related, as shown in FIG. 1, there has been proposed an apparatus for preventing water contained in cosmetic materials in a refill container from being evaporated, which is disclosed in Korean Registered Utility Model No. 20-0227336, where the cosmetic refill case has a sealing lid.

According to the related art, inner and outer walls 160 and 170 are formed on a case main body of a refill case 100 containing a cosmetic material 110 so that a space 150 having a predetermined width is formed between the inner and outer walls 160 and 170. A receiving protrusion 162 is formed in the space 150 and a support protrusion piece 180 is formed inside a case cover 140 which is opened or closed onto the case main body 120 based on a hinge shaft 130. A packing 190 made of rubber or silicon having excellent elasticity is coupled to the support protrusion piece 180 such that the support protrusion piece ISO is pressed by the packing 190, thereby preventing water of the cosmetic materials 110 contained in the case stain body 120 from being evaporated.

However, according to the sealing structure of the cosmetic refill case of the related art, since the base protrusion 162 and the packing 190 of the case main body 120 is forcibly pressed to seal the case main body 120 and the packing is mainly made of a material such as rubber to be hardened and worn out over time, the sealing ability may be deteriorated.

Thus, as shown in FIG. 2, the applicant of the present application had proposed a cosmetic case for preventing water of cosmetic materials front being evaporated disclosed in Korean Utility Model Application No. 20-0165402.

A refill container 200 for a cosmetic case according to the related art includes a container main body 210 containing a cosmetic material 180 and a cover 220 hinge-coupled to the container main body 210 to seal the container main body 210. An elastic packing 270 having with a packing wing 280 is interposed between inner and outer walls 240 and 250 of the container main body 210 and a support protrusion piece 260 corresponding to the packing wing 280 is formed on the cover 220. Thus, when the container main body 210 is closed with the cover 220, the support protrusion piece 250 formed on the cover 220 is fitted while pushing the packing wing 280 aside, so that the sealing ability of the refill container 200 is improved.

However, according to the related art, although the sealing is enhanced by the function of the elastic packing wing 280, when the refill container 200 containing cosmetic contents therein, is kept for a long time, due to the evaporation of water and volatilization of volatile ingredients, the pressure in the refill container 200 is increased, so that the elastic packing wing 280 is folded due to the pressure, thereby evaporating water and volatile materials.

In recent years, as shown in FIG. 3, to solve the problems described above, there has been, proposed a cosmetic refill case of an airtight type disclosed in Korean Registered Patent No. 10-1271359.

According to the related art, a container main body 310 is opened or closed with a lid 320 by a hinge. An assembly protrusion 315 protrudes from an upper edge of the container main body 310 and a groove 325, into which the assembly protrusion 315 is inserted, is formed in a lower edge of the lid 320. Assembly parts 326 protrude from inner and outer sides of the groove 325. In addition, protective walls 313 are further formed on inner and outer sides of the assembly-protrusion 315, such that the container main body 310 and the lid 320 are air-tightly coupled to each other.

However, according to the related art, although any packings of rubber are not used and the assembly protrusions and the grooves are coupled to one another while being offset to improve the sealing, when the container main body and the lid are used several times, the assembly protrusions and the grooves are worn due to friction so that the sealing ability may be greatly deteriorated.

Due to the problems described above, there has been a need to an apparatus for enhancing sealing of a cosmetic refill container and in addition, all techniques have been focused on the enhancement of the sealing of a cosmetic refill container. Thus, any studies of an auxiliary device for preventing cosmetic contents from, being evaporated by assisting a cosmetic refill container have not been performed at all.

In addition, although cosmetic refill cases according to the related art have mutually different sealing abilities, all cosmetic refill cases have been developed to have the sealing abilities. If a device for preventing evaporation of cosmetic contents in a cosmetic refill case, which is capable of enhancing the sealing ability of the cosmetic refill case, is developed, the device may be very useful to a customer or producer of a cosmetic refill case.

DISCLOSURE

Technical Problem

To solve the problems described above, an object of the present invention is to provide a device for preventing evaporation of cosmetic contents in a cosmetic refill case, which includes a support case and a coupler to allow a lid to be pressed while surrounding the cosmetic refill case such that the lid may be firmly coupled to the cosmetic refill case.

Another object of the present invention is to provide a device for preventing cosmetic contents in a cosmetic refill case from evaporating, which includes an additional prevention device for enhancing the sealing ability of the cosmetic refill case, such that the cosmetic contents may be prevented from evaporating even when the cosmetic refill case is kept for a long time.

Still another object of the present invention is to provide a device for preventing evaporation of cosmetic contents in a cosmetic refill case, which is capable of strongly pressing a lid toward a case stain body by forming a plurality of couplers even though a sealing packing of a cosmetic refill case according to the related art is worn out.

Still another object of the present invention is to provide a device for preventing evaporation of cosmetic contents in a cosmetic refill, case, which is capable of increasing productivity to reduce the manufacturing cost by manufacturing a support case and a coupler which are connected to each other through an integrated hinge.

Still another object of the present invention is to provide a device for preventing evaporation of cosmetic contents in a cosmetic refill case, which is capable of allowing a coupler to be smoothly operated by forming a hinge for connecting a support case and the coupler to each other in a butterfly shape.

Still another object of the present invention is to provide a device for preventing evaporation of cosmetic contents in a cosmetic refill case, which is capable of preventing a coupler from being released from a lid of the cosmetic refill container without user's intention by forming a coupling protrusion sill on an upper end of the coupler when the coupler is coupled to the lid.

Technical Solution

The present invention provides a device for preventing evaporation of cosmetic contents in a cosmetic refill case, which includes a support case (22) provided at a center thereof with a refill case accommodation space (22*e*) for accommodating the cosmetic refill case (10); and a coupler (24) integrated with an upper end of the support case (22) through a hinge (26).

The support case (22) is provided at the center thereof with the refill case accommodation space (22*c*) defined by a support case bottom (22*a*) and a support case side (22*b*) for accommodating the cosmetic refill case (10).

In addition, the coupler (24) is provided with a coupler side surface (24*a*) and a coupler upper surface (24*b*) perpendicular to each other in an inverted-L shape.

In addition, the device includes two to four couplers (24).

In addition the device includes a coupling protrusion sill (28) formed below a top surface (24*b*) of the coupler (24).

In addition, the hinge (26) has a butterfly shape (26*b*) such as an X shape.

Advantageous Effects

According to the device for preventing evaporation of cosmetic contents in a cosmetic refill case of the present invention, the device includes a support case and a coupler to allow a lid to be pressed while surrounding the cosmetic refill case, such that the lid may be firmly coupled to the cosmetic refill case.

In addition, the device provides an additional prevention device for enhancing the sealing ability of the cosmetic refill case, so that the cosmetic contents may be prevented from evaporating even when the cosmetic refill case is kept for a long time.

In addition, the lid is strongly pressed toward a case main body by forming a plurality of couplers even though a sealing packing of a cosmetic refill case according to the related art is worn out, so that the cosmetic contents in the cosmetic refill case may be prevented from evaporating.

In addition, by manufacturing the support case and the coupler which are connected to each other through an integrated hinge, the productivity is increased so that the manufacturing cost may be reduced.

In addition, the coupler is smoothly operated by forming a hinge for connecting a support case and the coupler to each other in a butterfly shape.

In addition, the coupling protrusion sill, is formed on an upper end of the coupler, so that the coupler is prevented from being released from the lid of the cosmetic refill container without user's intention after the coupler is coupled to the lid.

BEST MODE

[Mode for Invention]

Hereinafter, a device for preventing evaporation of cosmetic contents in a cosmetic refill case according to the present invention will be described with reference to accompanying drawings.

Figure 1:
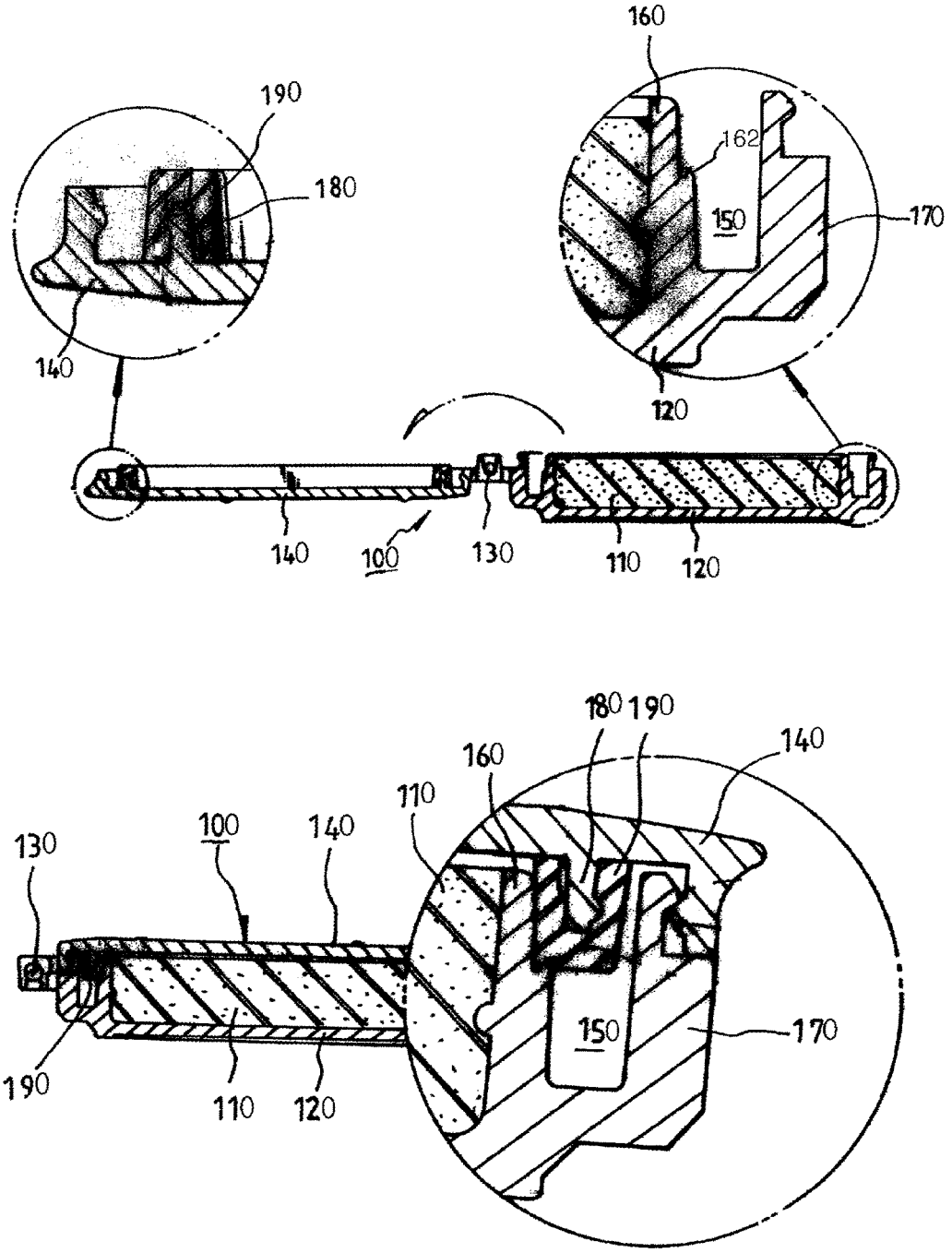
FIG. 1 is a sectional view of one cosmetic refill case according to the related art.
Figure 2:
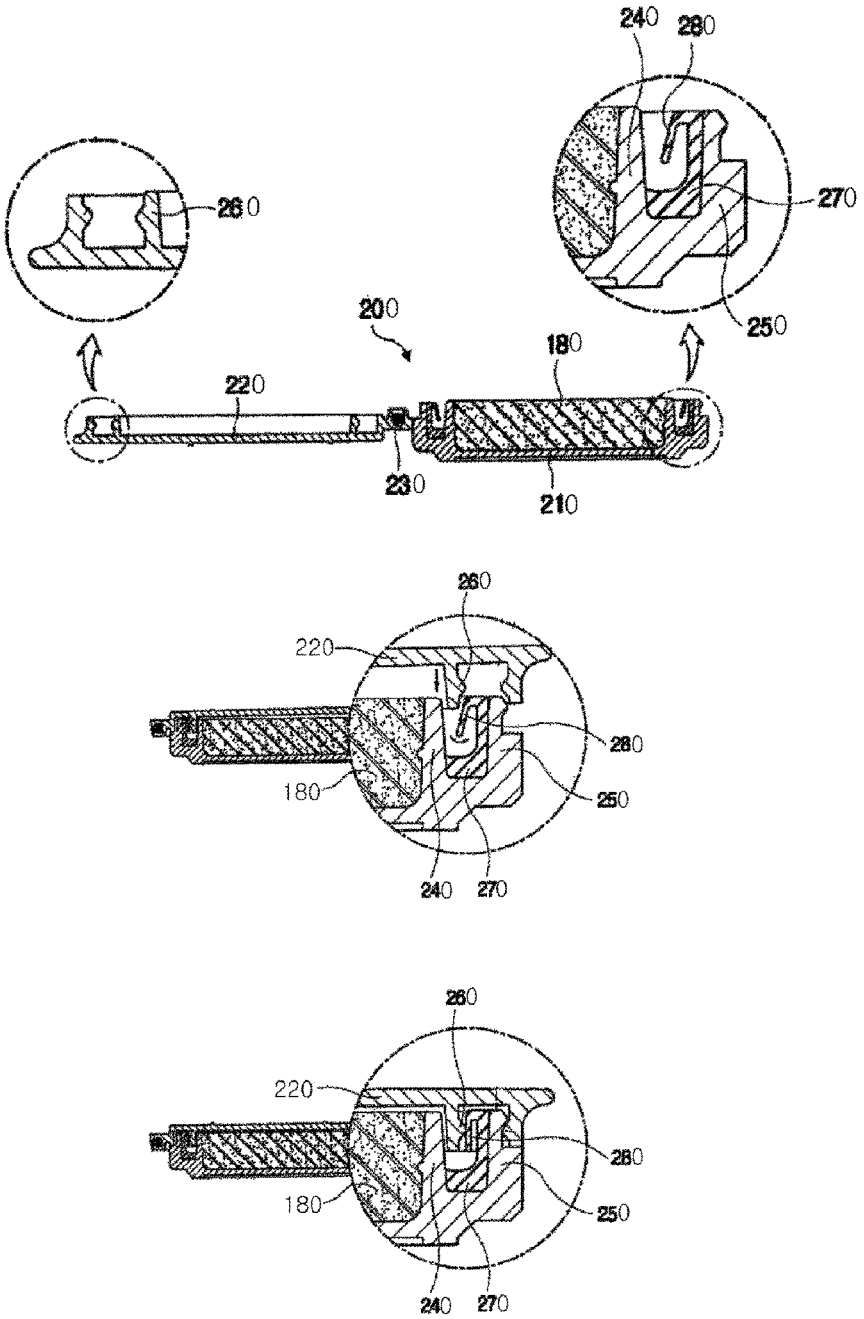
FIG. 2 is a sectional view of another cosmetic refill case according to the related art.
Figure 3:
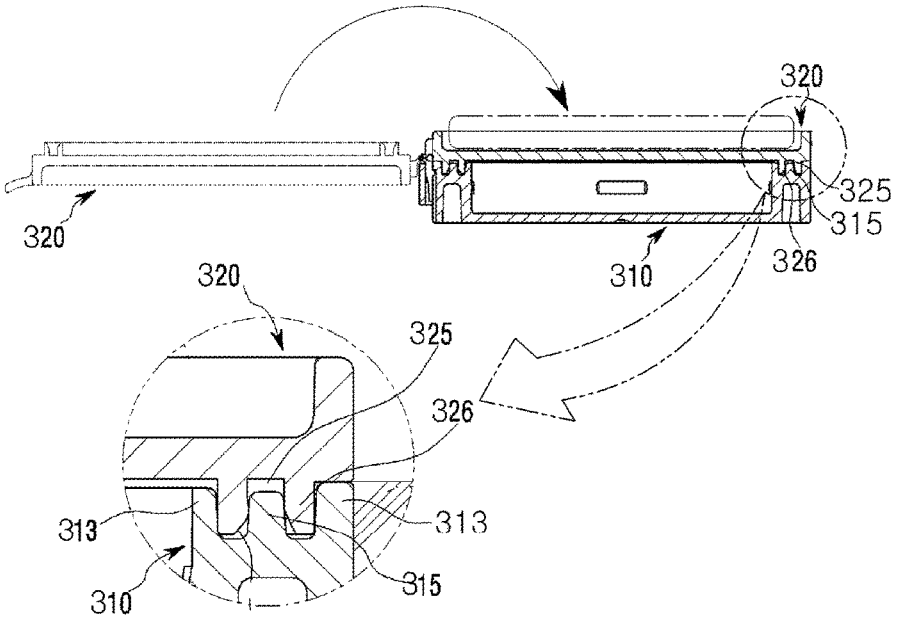
FIG. 3 is a sectional view of still another cosmetic refill case according to the related art.
Figure 4:
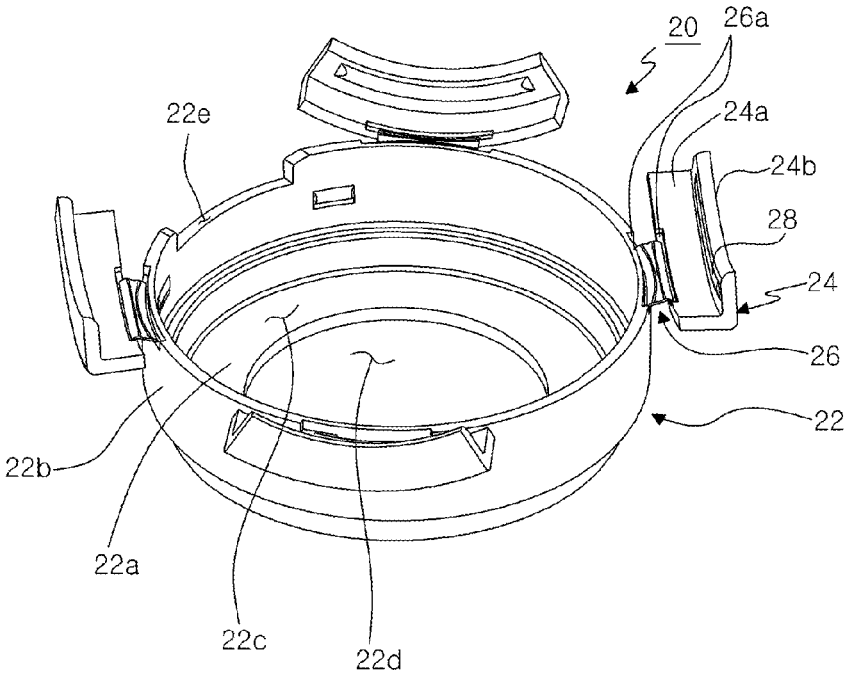
FIG. 4 is a perspective view showing a device for preventing
Figure 5:
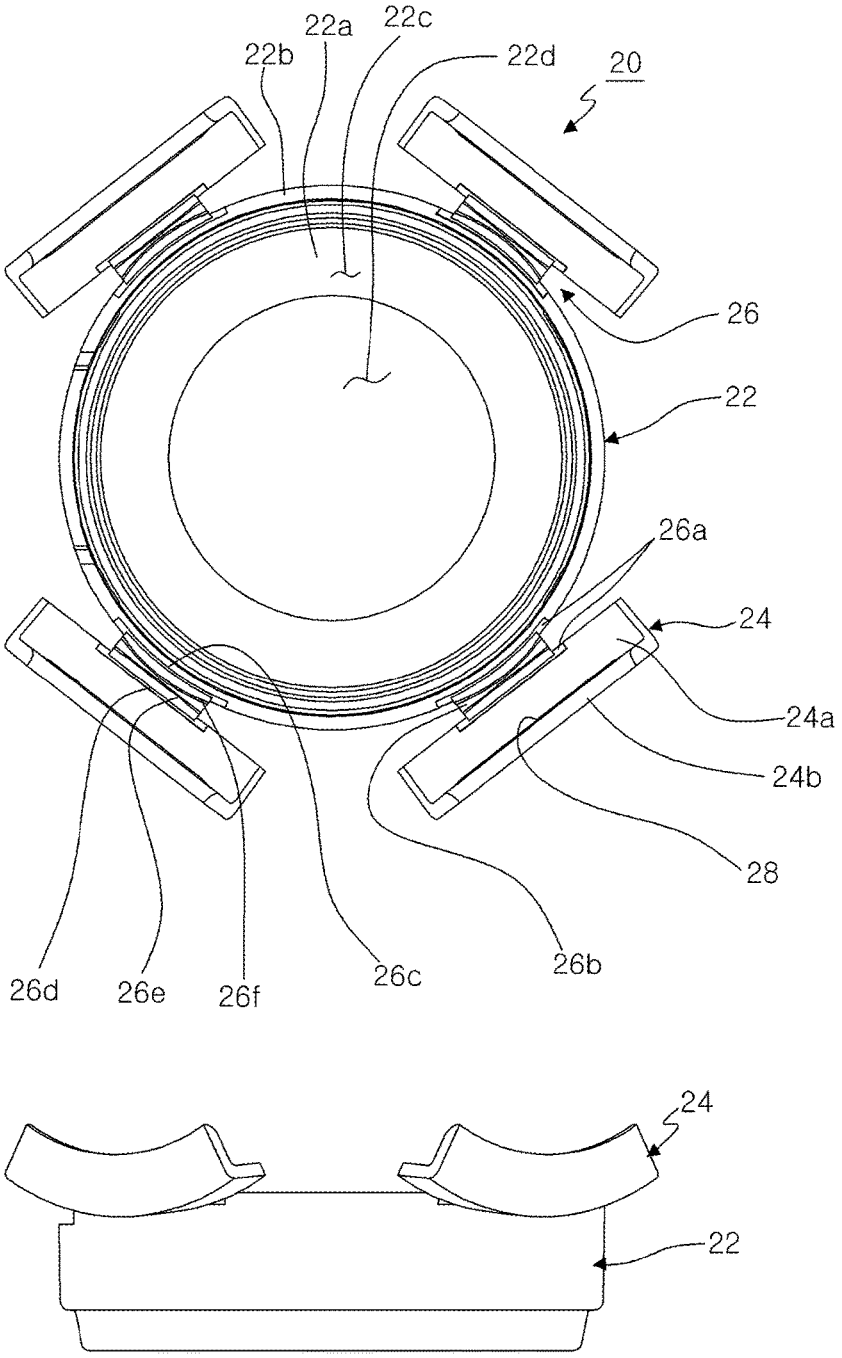
FIG. 5 is plan and front views allowing a device for preventing evaporation of cosmetic contents in a cosmetic refill case according to the present invention.

FIG. 4 is a perspective view showing a device for preventing evaporation of cosmetic contents in a cosmetic refill case according to the present invention. FIG. 5 is plan and front views showing a device for preventing evaporation of cosmetic contents in a cosmetic refill case according to the present invention.

The present invention provides a device for preventing evaporation of cosmetic contents in a cosmetic refill case, which includes a support case 22 provided at a center thereof with a refill case accommodation space 22*c* for accommodating the cosmetic refill case 10; and a coupler 24 integrated with, an upper end of the support case 22 through a hinge 26.

The support case 22 is provided at the center thereof with the refill case accommodation space 22*c* defined by a support case bottom 22*a* and a support, case side surface 22*b* for accommodating the cosmetic refill case 10.

Preferably, a hole 22*d*, through which air passes, is formed on a bottom surface 22*a* of the support case, such that compressed air is formed when the cosmetic refill case 10 is inserted into the refill case accommodation space 22*c*, thereby preventing the cosmetic refill case 10 from being easily inserted into the refill case accommodation space 22*c*.

Preferably, a hinge receiving space 22*e* may be formed in the support case side surface 22*b* such that a refill case hinge 16 is inserted into the hinge receiving space 22*e*. Various spaces may be formed corresponding to a shape of the cosmetic refill case 10.

The coupler 24 is integrally formed on an upper end of the side surface 22*b* of the supper case by the media of a hinge 26 and is provided with a coupler side surface (23*a*) and a coupler upper surface (24*b*) perpendicular to each other in an inverted-L shape.

In addition, two to four couplers 24 may be formed. When one coupler 24 is formed and coupled to the cosmetic refill case 10, the sealing of a part facing the one coupler 24 may be deteriorated. The reason is because the pressure on the lid 14 of the cosmetic refill case 10 is imbalanced on the whole so that water or volatile materials may be evaporated.

Thus, it is preferable to form at least two couplers 24. If five couplers 24 or more are formed, due to too many couplers 24 more than necessary, customers rather feel uncomfortable to couple the couplers 24 to the cosmetic refill case.

Thus, it is preferable to form two to four couplers 24 for usability and stability. Although four couplers 24 are depicted in the drawings, the embodiment is not limited thereto.

A coupling protrusion sill 28 is formed below a top surface 24*b* of the coupler 24.

Figure 10:
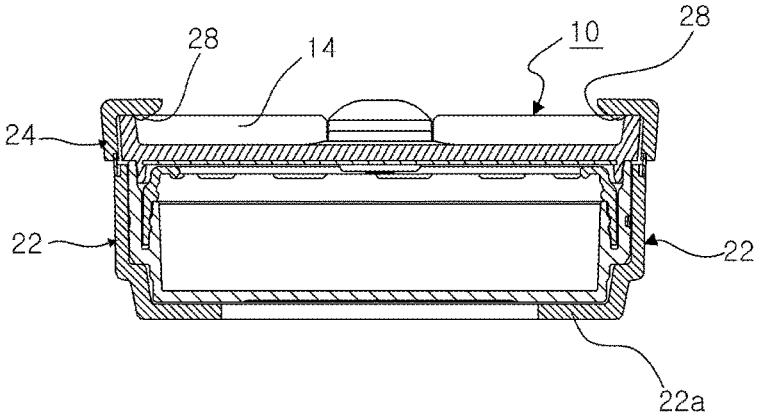
FIG. 10 is a side sectional view of FIG. 9.

When the coupler 24 is coupled to the lid 14 of the cosmetic refill case 10, as shown in FIG. 10', the coupling protrusion sill 28 is latched to an upper edge of the lid 14 so that the coupler 24 is not separated from the lid 14 unless a user forcibly separates the coupler 24 from the lid 14 with his force, so the coupler 24 may be prevented from being separated from the cosmetic refill case 10.

Although the coupling protrusion sill 28 caving a long circular arc shape is depicted in the drawings, the embodiment is not limited thereto and the coupling protrusion sill 28 may be formed, as a protrusion having a dot shape.

Preferably, the coupling protrusion sill (28) is configured as a rounded protrusion sill such that the coupling protrusion sill (28) is easily coupled to the lid (14) of the cosmetic refill case (10).

One side of the hinge 26 is integrally connected to an upper side end of a support case side surface 22*b* of the support case 22 and the opposite side is integrally connected to a lower end of the coupler side surface 24*a* of the coupler 24.

As shown in FIG. 4, a hinge connecting groove 26*a* is formed on the support case 22 and the coupler 24 and the hinge 26 is integrally connected to the hinge connecting groove 26*a*. Thus, as shown in FIG. 10, when the coupler 24 is coupled to the cosmetic refill case 10, the support case side surface 22*b*, the hinge 26 and the coupler side surface 24*a* are linearly aligned, so that the coupler 24 may be easily coupled to the lid 14 of the cosmetic refill case 10.

Preferably, the hinge (26) has a thickness thinner than thicknesses of the support case (22) and she coupler (24) such that the hinge (26) is easily folded.

The hinge (26) has a butterfly shape (26*b*) such as an X shape.

The hinge is integrally connected to an tipper end of the support case side surface 22*b* and a lower end of the coupler side surface 24*a*. Since the support case side surface 22*b* and the coupler side surface 24*a* are curved, the hinge (26) is formed in the butterfly shape (26*b*) such as an X shape to be integrally connected to the curved surfaces, so that the coupler 24 may be smoothly folded.

Preferably, to allow the hinge 26 to be more smoothly folded, a part 26*c* connected to a support case side surface 22*b*, a, part 26*d* connected to the coupler side surface 24*a*, and parts 26*e* and 26*f* folded at a left and a right of the hinge 26 and having a butterfly shape 26*b* such as an X shape are relatively thin to facilitate a smooth folding of the hinge 26.

The support case 22, the hinge 26 and the coupler 24 are integrally formed of the same material. Since the hinge 26 must have excellent flexibility and must not be cut even when being folded several times, it is preferable that the support case 22, the hinge 26 and the coupler 24 are integrally formed by polypropylene.

A state of using a device for preventing evaporation of cosmetic contents in a cosmetic refill case according to an embodiment of the present invention will be described in detail as follows.

Figure 6:
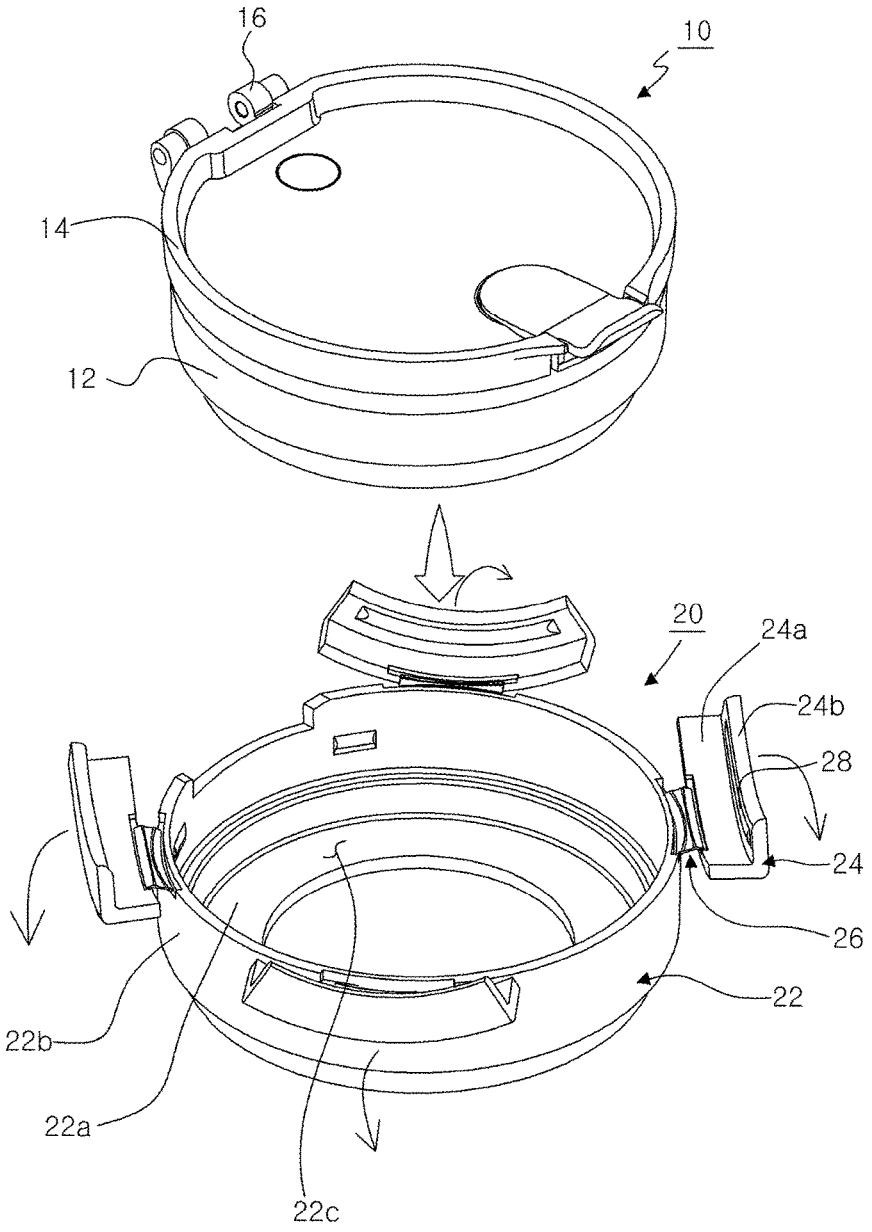
FIG. 6 is a perspective view showing a state before a cosmetic refill case is inserted into a device for preventing evaporation of cosmetic contents in a cosmetic refill case according to the present invention.
Figure 7:
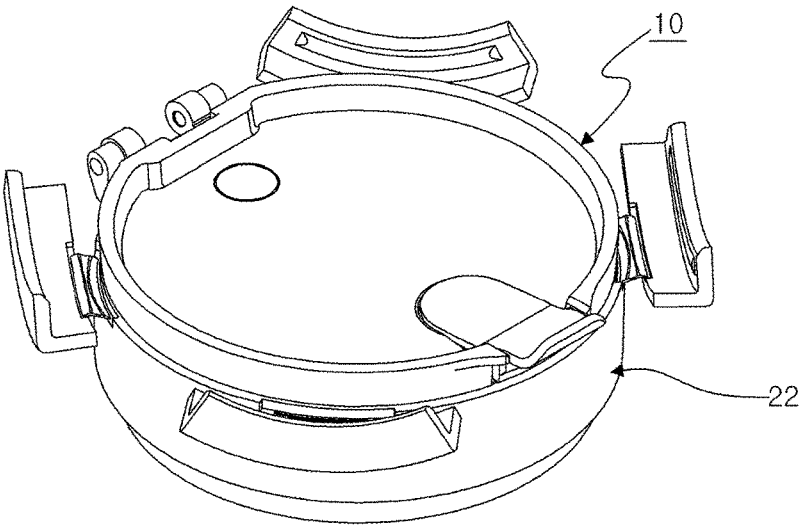
FIG. 7 is a perspective view showing a state that a cosmetic refill case is inserted into a device for preventing evaporation of cosmetic contents in a cosmetic refill case according to the present invention.
Figure 8:
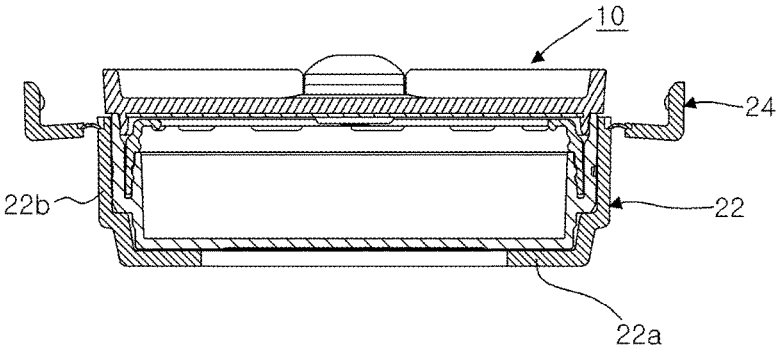
FIG. 8 is a side view of FIG. 7.
Figure 9:
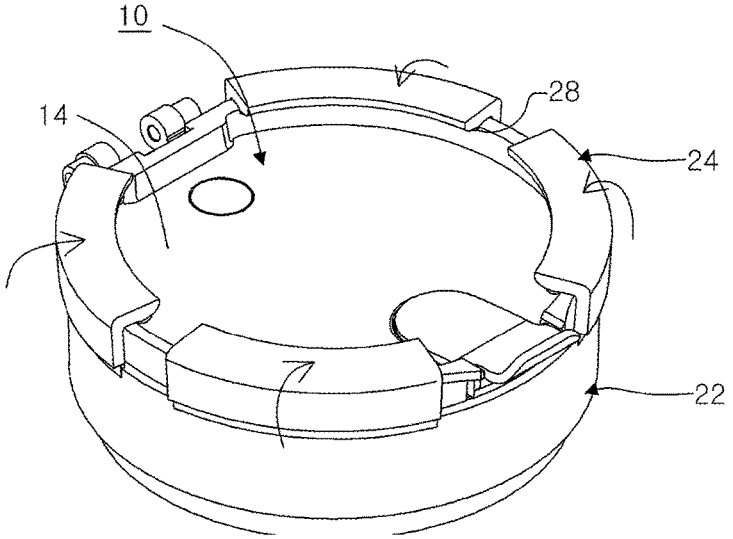
FIG. 9 is a perspective view showing a coupling state of a coupler after a cosmetic refill case is inserted into a device for preventing evaporation of cosmetic contents in a cosmetic refill case according to the present invention.

FIG. 6 is a perspective view showing a state before a cosmetic refill case is inserted into a device for preventing evaporation of cosmetic contents in a cosmetic refill case according to the present invention. FIG. 7 is a perspective view showing a state that a cosmetic refill case is inserted into a device for preventing evaporation of cosmetic contents in a cosmetic refill case according to the present invention. FIG. 8 is a side view of FIG. 7. FIG. 9 is a perspective view showing a coupling state of a coupler after a cosmetic refill case is inserted into a device for preventing evaporation of cosmetic contents in a cosmetic refill case according to the present invention. FIG. 10 is a side sectional view of FIG. 9.

When the device for preventing evaporation of cosmetic contents in a cosmetic refill case according to the present invention is used, as shown in FIG. 5, the cosmetic refill case 10 is mounted on the cosmetic content evaporation preventing device 20. After the coupler 24 is opened perpendicularly to the support case 22, the cosmetic refill case 10 is inserted into the refill case accommodation space 22*c*.

Then, in the state shown in FIG. 7, the cosmetic refill case 10 is accommodated in the support case 22 as shown in FIG., 8, so that the bottom surface of the refill case 10 is tightly closed to the support case bottom surface 22*a* of the support case 22, so the side surface of the cosmetic refill case 10 is tightly closed to the inside of the support, case side surface 22*b* of the support case 22.

Thereafter, as shown in FIG. 9, the coupler 24 is tightly coupled to the upper side end of the lid 14 of the cosmetic refill, case 10 by rotating the coupler 24.

Then, as shown in FIG. 10, all the couplers 24 are coupled to the upper side end of the lid 14 of the cosmetic refill lid 10 and she coupling protrusion sills 28 of the couplers 24 are tightly coupled to the upper side end of the lid 14 of the cosmetic refill case 10, so that the coupler 24 may not be separated unless a user forcibly separates the couplers 24 from the lid 14.

The device for preventing evaporation of cosmetic contents in a cosmetic refill case described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

DESCRIPTION OF REFERENCE NUMERAL

10: Cosmetic refill case
14: Lid
20: Device for preventing cosmetic contents from evaporating
22: Support case
22*a*: Support case bottom surface
22*b*: Support case side surface
22*c*: Refill case accommodation space
24: Coupler
24*a*: Coupler side surface
24*b*: Coupler top surface
26: Hinge
26*a*: Hinge connecting groove
26*c*: Butterfly shape
28: Coupling protrusion sill

The invention claimed is:

1. A device for preventing evaporation of cosmetic contents in a cosmetic refill case (10), the device comprising:

a support case (22) provided at a center thereof with a refill case accommodation space (22*c*) defined by a support case bottom (22*a*) and a support case side (22*b*) for accommodating the cosmetic refill case (10); and a coupler (24) integrated with an upper end of the support case (22) through a hinge (26), wherein the cosmetic refill case (10) is constructed to be inserted into the refill case accommodation space (22*c*) of support case (22), wherein the coupler (24) is provided with a coupler side surface (24*a*) and a coupler upper surface (24*b*), both surfaces being substantially perpendicular to each other in an inverted-L shape, wherein the coupler (24) is constructed to rotate to be coupled to an upper vertical end of a lid (14) of the cosmetic refill case (10) such that, as the coupler (24) rotates, the coupler (24) contacts a top portion of the upper vertical end of the lid (14) and further rotation of the coupler (24) presses down the upper vertical end of the lid (14) that increases a downward pressure until the coupler (24) completes its rotation and is reversibly coupled on the upper vertical end of the lid (14) such that the coupler (24) presses the upper vertical end of the lid (14) on to a refill case main body (12) securing, in an airtight seal, the cosmetic refill case (10) to the support case (22), and wherein a coupling protrusion sill (28) is constructed to protrude outwardly from the coupler (24) and to securely, and reversibly, contact an inner portion of the upper vertical end of the lid (14) of the cosmetic refill case (10) when the coupler (24) completes its rotation.

2. The device of claim 1, wherein a hole (22*d*), through which air passes, is formed on the support case bottom (22*a*), such that compressed air is formed when the cosmetic refill case (10) is inserted into the refill case accommodation space (22*c*), thereby preventing the cosmetic refill case (10) from being easily inserted into the refill case accommodation space (22*c*).

3. The device of claim 1, wherein the device includes two to four couplers (24).

4. The device of claim 1, further comprising the coupling protrusion sill (28) formed below a top surface (24*b*) of the coupler (24).

5. The device of claim 4, wherein the coupling protrusion sill (28) has a long circular arc shape.

6. The device of claim 4, wherein the coupling protrusion sill (28) is configured as a rounded protrusion sill such that the coupling protrusion sill (28) is easily coupled to the lid (14) of the cosmetic refill case (10).

7. The device of claim 1, wherein the hinge (26) has a butterfly shape (26*b*).

8. The device of claim 1, wherein the support case (22) and the coupler (24) are provided with hinge connecting grooves (26*a*).

9. The device of claim 1, wherein the hinge (26) has a thickness thinner than thicknesses of the support case (22) and the coupler (24) such that the hinge (26) is easily folded.

10. The device of claim 9, wherein a part (26*c*) connected to the support case side surface (22*b*), a part (26*d*) connected to a coupler side surface (24*a*), and parts (26*e* and 26*f*) folded at a left and a right of the hinge (26) and having a butterfly shape (26*b*) are relatively thin to facilitate a smooth folding of the hinge (26).

11. The device of claim 1, wherein the support case (22), the hinge (26) and the coupler (24) are integrally formed by polypropylene.

12. The device of claim 1, wherein a hole (22*d*),through which air passes, is formed on the support case bottom (22*a*), such that compressed air is formed when the cosmetic refill case (10) is inserted into the refill case accommodation space (22*c*), thereby preventing the cosmetic refill case (10) from being easily inserted into the refill case accommodation space (22*c*).

13. The device of claim 1, wherein the coupling protrusion sill (28) is formed below a top surface (24*b*) of the coupler (24), wherein the coupling protrusion sill (28) has a long circular arc shape such that the coupling protrusion sill (28) is constructed to couple to the lid (14) of the cosmetic refill case (10) and reversibly lock on to the lid (14).

* * * * *